US005585834A

United States Patent [19]

Nagano

[11] Patent Number: 5,585,834

[45] Date of Patent: Dec. 17, 1996

[54] THERMAL RECORDING APPARATUS WITH CONTROLLED ENERGIZING TIME

[75] Inventor: Fumikazu Nagano, Yamato-Koriyama, Japan

[73] Assignee: Sharp Kabushiki Kaisha, Osaka, Japan

[21] Appl. No.: 449,696

[22] Filed: May 24, 1995

Related U.S. Application Data

[62] Division of Ser. No. 71,276, Jun. 4, 1993.

[30] Foreign Application Priority Data

Jun. 8, 1992 [JP] Japan ..... 4-147376

[51] Int. Cl.[6] ..... B41J 2/36

[52] U.S. Cl. ..... 347/211; 367/183

[58] Field of Search ..... 347/183, 211; 400/120.07; 358/298

[56] References Cited

U.S. PATENT DOCUMENTS

| | | | |
|---|---|---|---|
| 3,694,509 | 1/1971 | Sarich | 418/61 |
| 3,703,445 | 11/1972 | Tew | 418/61 |
| 3,994,000 | 6/1975 | Reitter | 418/61 |
| 4,325,777 | 5/1982 | Wolfe | 418/63 |
| 4,633,269 | 12/1986 | Mikami et al. . | |
| 4,675,695 | 6/1987 | Samuel . | |
| 4,806,950 | 2/1989 | Sekine et al. | 347/183 |
| 4,984,092 | 1/1991 | Kato et al. . | |
| 5,142,302 | 8/1992 | Kano . | |

FOREIGN PATENT DOCUMENTS

| | | | |
|---|---|---|---|
| 9141 | 8/1979 | European Pat. Off. . | |
| 0018762 | 4/1980 | European Pat. Off. . | |
| 0458507 | 11/1991 | European Pat. Off. . | |
| 1137729 | 6/1965 | Germany | 418/63 |
| 50-3106 | 11/1979 | Japan | 260/424 |
| 59-23672 | 6/1984 | Japan . | |
| 59-187877 | 10/1984 | Japan . | |
| 61-4367 | 1/1986 | Japan . | |
| 61-157063 | 7/1986 | Japan . | |
| 63-28669 | 2/1988 | Japan . | |
| 3-219969 | 9/1991 | Japan . | |
| 2219425 | 12/1989 | United Kingdom . | |
| WO80/01871 | 9/1980 | WIPO . | |

OTHER PUBLICATIONS

Kovach, et al "Simple Precision RC Oscillator,"IBM Tech. Disclosure Bulletin vol. 16, No. 10. Mar. 1974, pp. 3174–3175.

*Primary Examiner*—Huan H. Tran

[57] ABSTRACT

A thermal recording apparatus includes a thermal head. Printing for multi-tone density is performed by changing an energizing time of the thermal head. The apparatus has a controller for controlling the energizing time and an interrupting circuit. The controller controls the energizing time to match to a value corresponding to a tone density for printing. The interrupting circuit puts an interrupt period of energizing for the energizing time if the energizing time is equal to or more than a predetermined time. The thermal head is pre-heated when printing data is not zero so that linear relation between the energizing time and the printing density can be obtained even if the printing density is low.

2 Claims, 16 Drawing Sheets

THERMAL RECORDING APPARATUS WITH CONTROLLED ENERGIZING TIME

This application is a divisional of copending application Ser. No. 08/071,276, filed on Jun. 4, 1993, the entire contents of which are hereby incorporated by reference.

BACKGROUND OF THE INVENTION

1. Field of the Invention

The present invention relates to a thermal type recording apparatus, and more particularly to the thermal type recording apparatus which operates to do recording at halftone density by changing an energizing time of a thermal head.

2. Description of the Related Art

A thermal head section of the conventional sublimating type printer for enabling halftone recording is illustrated in FIG. 8. The thermal head section is arranged to have a thermal head or a thermal element (referred to as "head") 81, a platen 83, an image-receiving paper 82 and an ink ribbon 86. The image-receiving paper 82 and the ink ribbon 86 are laid between the head 81 and the platen 83. The ink ribbon 86 is heated by the head 81 so that the ink on the ink ribbon 86 is transferred onto the image-receiving paper 82. The ink ribbon 86 is fed or wound around two rollers 84 and 85 along the progress of printing.

FIG. 9 shows a driving circuit of the head 81. The head 81 provides n heads (n is an integer). Resistors R1 to Rn stand for the heads. Each one end of the resistors R1 to Rn is commonly connected to a power supply VTH and the other ends are respectively connected to the collectors of NPN transistors TR1 to TRn. The emitters of the transistors TR1 to TRn are connected on the ground GND. The bases of the transistors TR1 to TRn are respectively connected to the outputs of the AND circuits GT1 to GTn.

A strobe signal STRB is fed to one inputs of the AND circuits GT1 to GTn. The other inputs of the AND circuits are connected to an output Q of flip-flop circuits (referred to as "FF circuit") FF1 to FFn. And, an active load pulse LOAD is fed to the set inputs S of the FF circuits FF1 to FFn. The reset inputs are connected to the outputs of L active circuits INV1 to INVn.

If, therefore, the L active load pulse LOAD is input and the FF circuits FF1 to FFn are set so that those outputs Q are made to be at high level when the strobe signal STRB is at high level, the outputs of the AND circuits CT1 to GTn are made at high level. The transistors TR1 to TRn are turned on so that current may flow through the resistors R1 to Rn, thereby heating the thermal elements. On the other hand, if the inverting circuits INV1 to INVn supplies L-level outputs, the corresponding FF circuits FF1 to FFn are reset so as that those outputs Q are made at L level. Hence, the energizing of the corresponding transistors TR1 to TRn is interrupted so that heating of the corresponding resistors R1 to Rn may be stopped.

Counters CNT1 to CNTn denote synchronous up counters which may load four-bit initial numerical values. This counter is counted up at a leading edge of a clock TPW. When the asynchronous L active load pulse LOAD is made at L level, the values fed to the inputs A to D are read and are output at the output QA to QD. After the count value of the counter reaches zero, the output MAX is made at H level at the leading edge of the fifteenth clock TPW and then is returned to L level at the leading edge of the next clock. Those counters serve to feed H-level signals to the inverting circuits INV1 to INVn on a predetermined timing, respectively, for controlling the energizing times of the resistors R1 to Rn. The inputs A to D of the counters are connected to the outputs QA to QD of the latch circuits L1 to Ln. Each output MAX is connected to the inputs of the inverting circuits INV1 to INVn.

Data D1 to D4 are fed to the inputs 1D to 4D of the latch circuit L1, the outputs QA to QD of which are connected to the inputs 1D to 4D of the latch circuit L2. Likewise, with respect to the latch circuits L3 to Ln−1, the input of each latch is connected to the outputs of the latch circuits having one smaller number. The output of each latch is connected to an input of each latch circuit having one larger number. The outputs QA to QD of the latch circuit Ln are respectively connected to the inputs A to D of the counter CNTn. A latch pulse TD is fed to the clock inputs T of the latch circuits L1 to Ln.

The operation of the driving circuit arranged as above will be described as referring to a timing chart of FIG. 10. In this embodiment, the number n of heads is 256 and the strobe signal STRB is constantly kept at H level. Further, the description will be made as taking an example of controlling the energizing of the resistor R1.

On the timing when each scan is started, an L-level load pulse LOAD is input so as to set the FF circuit FF1. Hence, the output of the AND circuit GT1 is made at H level, the transistor TR1 is switched on and the energizing of the resistance R1 is started.

On the other hand, as a latch pulse TD, the same number, 256, of pulses as the elements for each scan are input and data D1 to D4 are fed in synchronous to each latch pulse TD. For example, when starting M-th scan (M scan), an L-level load pulse LOAD is input. If a first latch pulse TD is input on the timing, the data D1 to D4 being fed are latched by a latch circuit L1 and are fed to the counter CNT1. And, since the L-active load pulse LOAD is at L level, the counter CNT1 operates to read data from the latch circuit L1 and use it as an initial value for calculation. Then, when the clock TPW is input and the count value reaches 15, the counter CNT1 outputs a H-level signal at the output MAX.

For example, if the first given data D1 to D4 are 0, 0, 1 and 1, the outputs QA to QD of the latch circuit L1 are made to be 0, 0, 1 and 1 and the initial count value of the counter CNT1 reaches 12. Hence, when a third clock TPW is input, the output MAX is made at H level. Hence, assuming that one period of the clock TPW is t0, after feeding the L-level load pulse LOAD, the output Q of the FF circuit FF1 is maintained for a period of 3·t0. Then, when the output MAX reaches H level, the FF circuit FF1 is reset so that the output Q may reach L level. That is, if 0, 0, 1 and 1 are given at data D1 to D4, the resistor R1 is energized for a period of 3·t0.

Next, it is assumed that at the (M+1) th scan, 0, 0, 0, 1 are given as data D1 to D4. In this case, the counter CNT1 starts to count with an initial value of 8. At a time when a seventh clock TPW is input, the output MAX is at H level. Hence, the resistor R1 is energized for a period of 7·t0.

It is assumed that at the (M+2)th scan, 1, 1, 0, 0 are given at data D1 to D4. In this case, the counter CNT1 starts to count with an initial value of 3. When the twelve clock TPW is input, the output MAX is made at H level. Hence, the resistor R1 is energized for a period of 12·t0.

In general, assuming that the values of the data D1 to D4 are K, the resistor R1 is kept energized for a period of $(2^4-1-K)\cdot t0$.

That is, by changing the values of the data D1 to D4, it is possible to change the energizing time of the thermal elements and perform halftone recording more easily.

In such a conventional printer, however, as shown by a graph of FIG. 15, the printing density (2) is not proportional to the energizing time. In particular, if the energizing time is 1·t0, 2·t0, and 3·t0, no first tone to third tone printing is performed. In addition, the maximum density is not printed satisfactorily.

To solve these problems, for enhancing the voltage applied to the head, the leading of the thermal head temperature (1) is made acute as shown in FIG. 18, thereby expanding the printing range at low tone. However, there may take place a problem that the printing density (2) is saturated at high tone. Further, this problem holds true to the case that the head is affected by an ambient temperature or the temperature of the head is changed.

SUMMARY OF THE INVENTION

It is an object of the present invention is to provide a thermal type recording apparatus which is capable of solving these problems, linearly changing the printing density on an overall area for an energizing time, and protecting itself from the adverse effect from the environment.

According to a first invention, a thermal type recording apparatus for performing printing at multi-tone density by changing an energizing time of a thermal head is characterized by providing means for controlling the energizing time to match to a value corresponding to a tone density for printing and interrupting means for putting an interrupt period of energizing for the energizing time if the energizing time is equal to or more than a predetermined time.

According to a second invention, a thermal type recording apparatus for performing printing at multi-tone density by changing an energizing time of a thermal head is characterized by providing means for putting a dummy printing period before a normal printing period according to a tone density and means for controlling the energizing of the thermal head to be executed for the dummy printing period when doing printing at a first or more tone density or to be interrupted for the dummy printing period when doing no printing.

According to a third invention, a thermal type recording apparatus for performing printing at multi-tone density by changing an energizing time of a thermal head is characterized by providing voltage control means for adjusting a voltage applied to the thermal head according to the tone density for printing.

According to a fourth invention, a thermal type recording apparatus for performing at multi-tone density by changing an energizing time of a thermal head is characterized by providing control means for changing the energizing time according to the change of an ambient temperature.

In the thermal type recording apparatus according to the first invention, if the energizing time of the head is equal to or more than a predetermined time, the energizing is interrupted for a predetermined time once or more times. If the energizing time applied to the head is made longer, it is possible to prevent the temperature of the head from being higher than required. This function makes it possible to realize a thermal type recording apparatus which operates to solve the problem that no printing takes place at low tone density and a printing density is saturated at high tone density and to change the printing density linearly with the energizing time. Further, since the temperature of the head is prevented from being higher than required, the life of the head is made longer.

In the thermal type recording apparatus according to the second invention, a bias energizing is done for the head for a predetermined time before energizing of the head for printing. Hence, for the low tone density, the printing is done at a density for each tone. The printing density for the energizing time is changed linearly on all the area.

In the thermal type recording apparatus according to the third invention, the voltage applied to the head is adjusted according to the recording density. This adjustment makes it possible to solve the problem that no printing takes place at low tone density and a printing density is saturated at high tone density and to realize the thermal type recording apparatus which operates to change the printing density linearly to the energizing time.

In the thermal type recording apparatus according to the fourth invention, the energizing time of the head is adjusted according to the ambient temperature. This adjustment makes it possible to solve a problem that no printing takes place at low temperature and low tone and a printing density is saturated at a high temperature and high tone and to realize a thermal type recording apparatus which operates to stabilize the printing density without having to be influenced by the change of the ambient temperature.

Further objects and advantages of the present invention will be apparent from the following description of the preferred embodiments of the invention as illustrated in the accompanying drawings.

DESCRIPTION OF THE PREFERRED EMBODIMENTS

Figure 1:
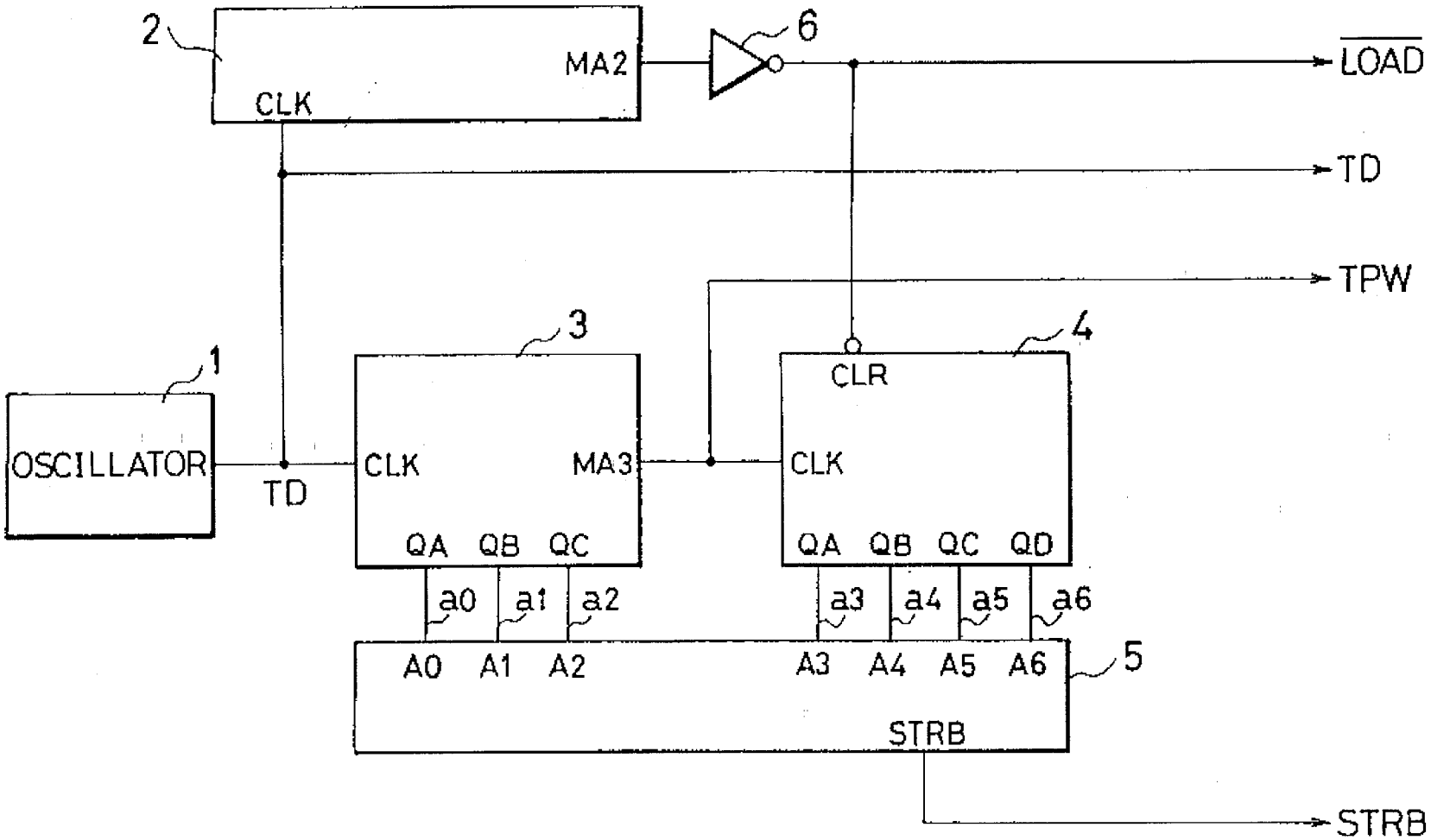
FIG. 1 is a circuit diagram showing a part of a thermal head driving circuit included in the thermal type recording apparatus according to the first invention.
Figure 9:
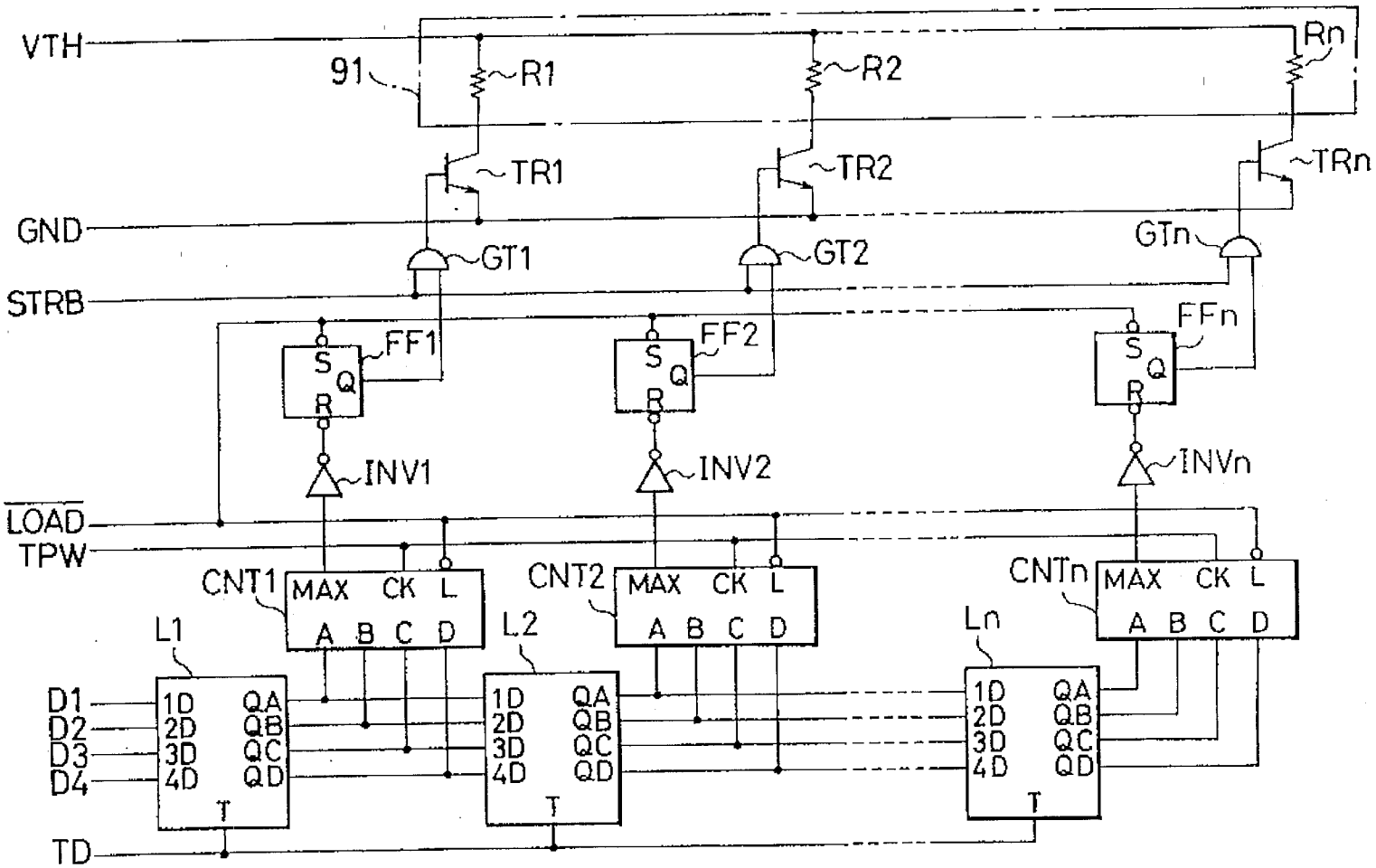
Fig. 9 PRIOR ART
FIG. 9 is a block diagram showing the conventional driving circuit for driving the thermal head of the thermal type recording apparatus.
Figure 10:
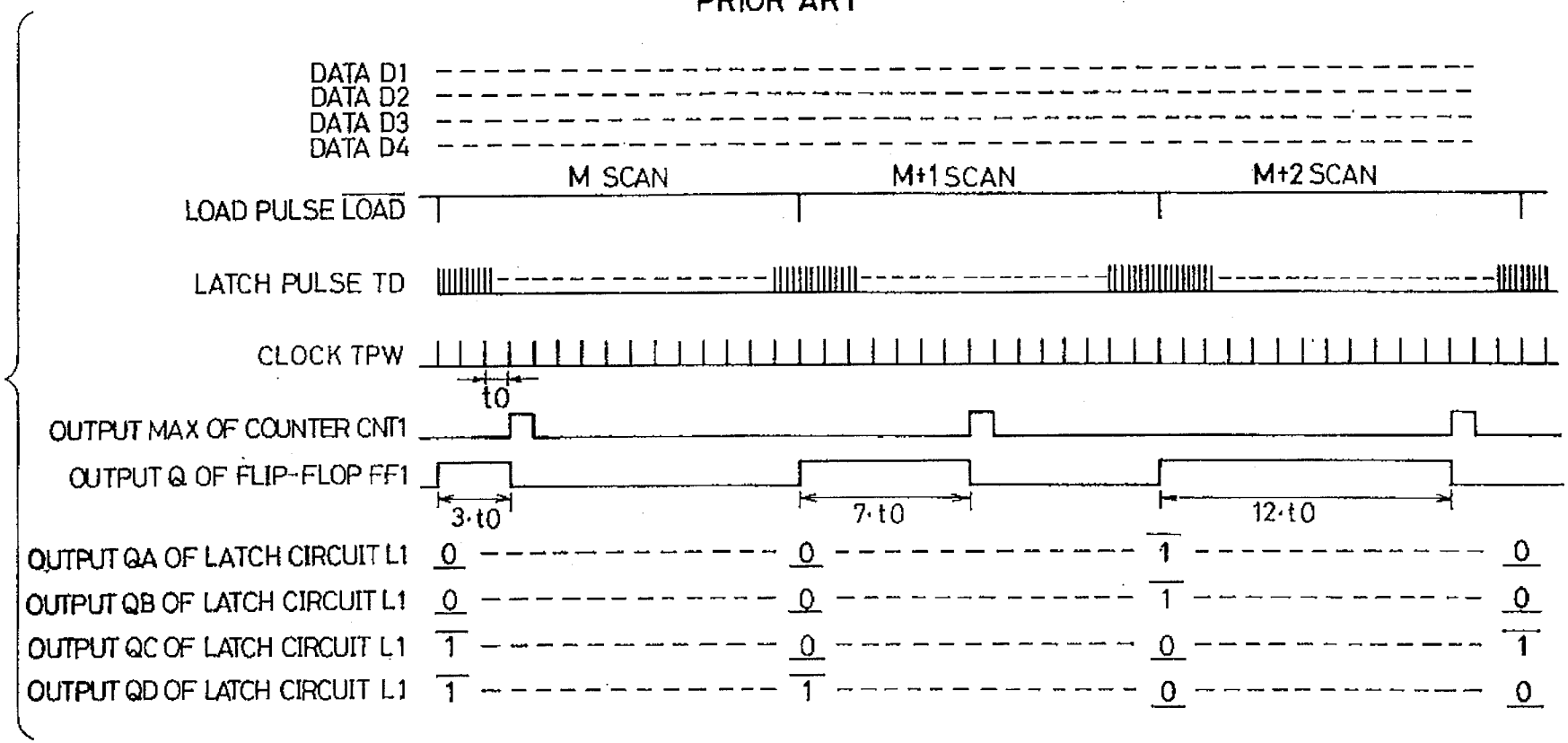
Fig. 10 PRIOR ART
FIG. 10 is a timing chart for explaining an operation of the driving circuit shown in FIG. 9.

Next, the description will be oriented to the embodiment of a thermal type recording apparatus based on the halftone recording method according to the first invention as referring to the drawings. The head driving circuit of the thermal type recording apparatus according to this embodiment is arranged to add a circuit shown in FIG. 1 to the foregoing circuit shown in FIG. 9. The circuit shown in FIG. 9 has been described in the section of [Prior Art]. Hence, the description about the circuit shown in FIG. 9 is left out and the circuit shown in FIG. 1 will be described. In this embodiment, the number of heads is 256.

This circuit is arranged to have one oscillator 1, three counters 2 to 4, one read-only memory (ROM) 5, and one inverter circuit 6. The counter 2 is a 256-system counter, the output MA2 of which is made at H level if the number of counted clocks reaches 256. The counter 3 is an 8-system counter, the output MA3 of which is made at H level if the outputs QA to QC are all made at H level. The counter 4 is a 16-system counter. The storage capacity of the ROM 5 is 128 bits.

A latch pulse TD output from the oscillator 1 is fed to a clock input CLK of the counters 2 and 3 and then to the latch circuits L1 to Ln shown in FIG. 9. The outputs QA to QC of the counter 3 are respectively connected to the address inputs A0 to A2 of the ROM 5. The outputs QA to QD of the counter 4 are respectively connected to the address inputs A3 to A6 of the ROM 5. The, output MA3 of the counter 3 is connected to the clock input CLK of the counter 4. The signal is fed from the output MA3 of the counter 3 to the counters CNT1 to CNTn shown in FIG. 9 as a clock TPW. The output MA2 of the counter 2 is connected to the input of the inverting circuit 6. The output of the inverting circuit 6 is connected to the clear input CLR of the counter 4. The output signal of the inverting circuit 6 is fed to the circuit shown in FIG. 9 as an L-active load pulse LOAD. From an output terminal of the ROM 5, the strobe signal STRB is fed to the circuit shown in FIG. 9.

The storage content of the ROM 5 includes the following outputs "strb" of the strobe signal STRB against the bit data a0 to a6 of the address inputs A0 to A6.

TABLE 1

| a0 | a1 | a2 | a3 | a4 | a5 | a6 | strb |
|---|---|---|---|---|---|---|---|
| X | X | X | X | X | 0 | 0 | 1 |
| 0 | 1 | 1 | X | X | 1 | 0 | 0 |
| Except the above | | | X | X | 1 | 0 | 1 |
| 0 | 1 | 1 | X | X | 0 | 1 | 0 |
| 1 | 0 | 1 | X | X | 0 | 1 | 0 |
| X | X | 0 | X | X | 0 | 1 | 1 |
| 0 | 1 | 1 | X | X | 1 | 1 | 0 |
| X | 0 | 1 | X | X | 1 | 1 | 0 |
| 1 | 1 | 1 | X | X | 1 | 1 | 1 |
| X | X | 0 | X | X | 1 | 1 | 0 |

Figure 2:
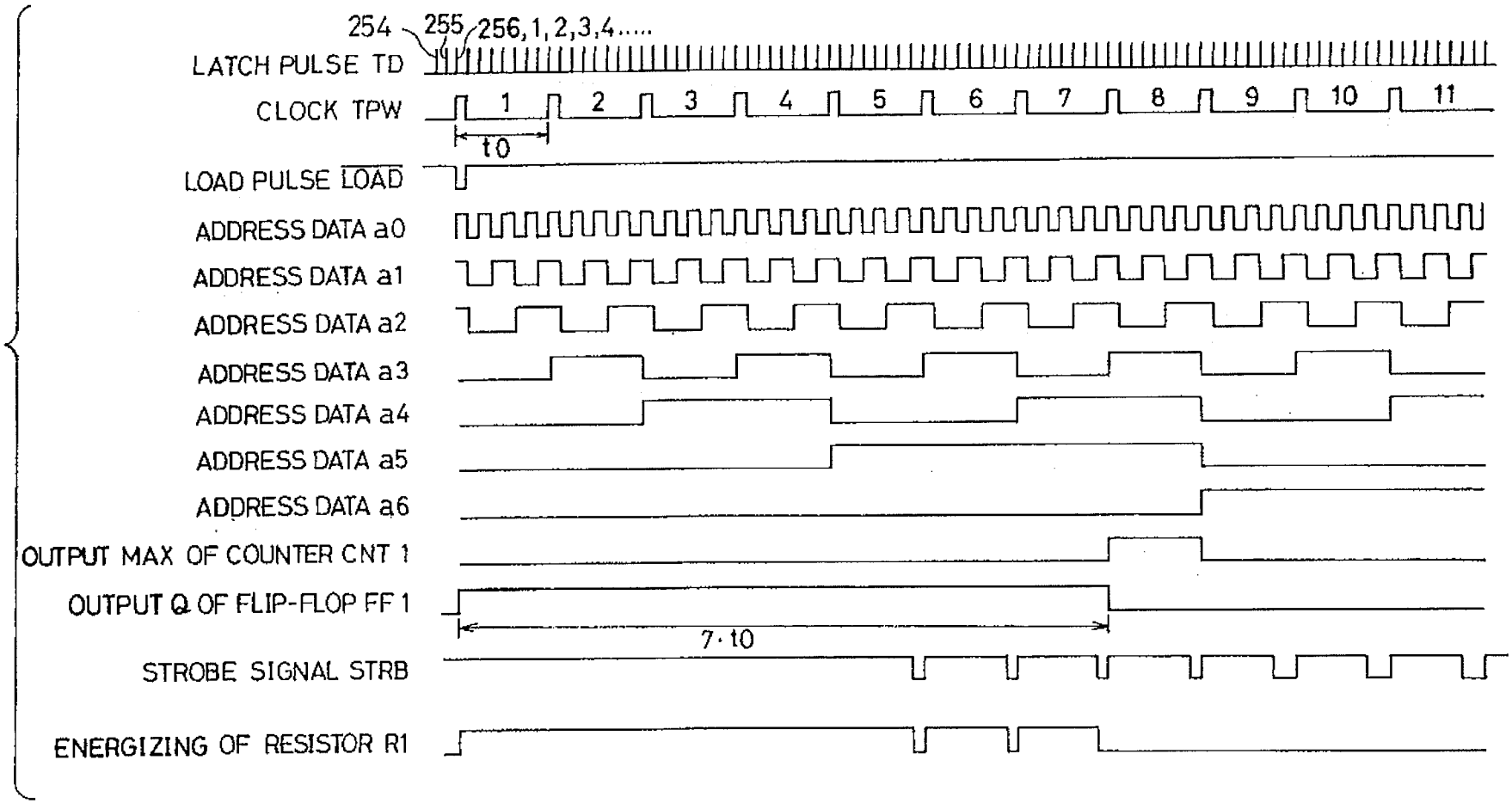
FIG. 2 is a timing chart for explaining an operation of the driving circuit shown in FIG. 1.

The description will be directed to the operation as referring to a timing chart of FIG. 2. The counter 2 counts a latch pulse TD output from the oscillator 1. Each time 256 latch pulses TD are counted, the output MA2 is made at H level. The H-level signal is output as an L-level load pulse LOAD signal through the inverting circuit 6. The counter 3 counts the latch pulse TD. Each time eight latch pulses TD are counted, the output MA3 is made at H level. Further, for each of eight latch pluses, one clock TPW is output. The counter 4 is reset so that the count value may be zero when the L-active load pulse LOAD is made at L level. Then, the counter 4 increases its count value one by one each time the clock TPW is input. On the timing of the first latch pulse TD immediately after the L-active load pulse LOAD, all the outputs of the counters 3 and 4 are made at L level. The bits a0 to a6 of the address data given to the ROM 5 are all made to be "0" and the strobe signal STRB is made at H level. The relation is shown in FIG. 2 and Table 1.

Each time the latch pulse TD is input in the above state, the value of the address data is increased one by one. From each address of the ROM 5, a value "strb" of the strobe signal is read out sequentially and the strobe signal STRB at the level according to the value is output. The storage content of the ROM 5 is listed in Table 1. As shown in FIG. 2, the strobe signal STRB remains at H level for the first four periods of the clock TPW, that is, 4·t0 and is made at L level during one latch pulse TD on the last timing of the fifth period. Then, until the eighth periods, on the last timing of each period, the strobe signal STRB is kept at L level for an interval of one latch pulse TD. After the ninth period of the clock TPW, on the last timing of each period, the strobe signal STRB is made at L level between the two latch pulses TD. After the twelfth period of the clock TPW, on the last timing of each period, the strobe signal STRB is made at L level for an interval of three latch pulses TD.

In the circuit shown in FIG. 9, if the data D1 to D4 are given so that the output MAX of the counter CNT1 is made at H level at the eighth period of the clock TPW and the output Q of the FF circuit FF1 is made at H level for an interval of 7·t0 as shown in FIG. 2, the resistor R1 is energized for an interval of 7·t0. In actual, however, since the strobe STRB has a waveform as described above, the energizing is interrupted twice for an interval of one latch pulse TD at the last part of the energizing period. This driving circuit operates to interrupt the energizing in twice if the energizing time is equal to or longer than 5·t0, thereby preventing the temperature of the head from being raised too much.

Figure 3:
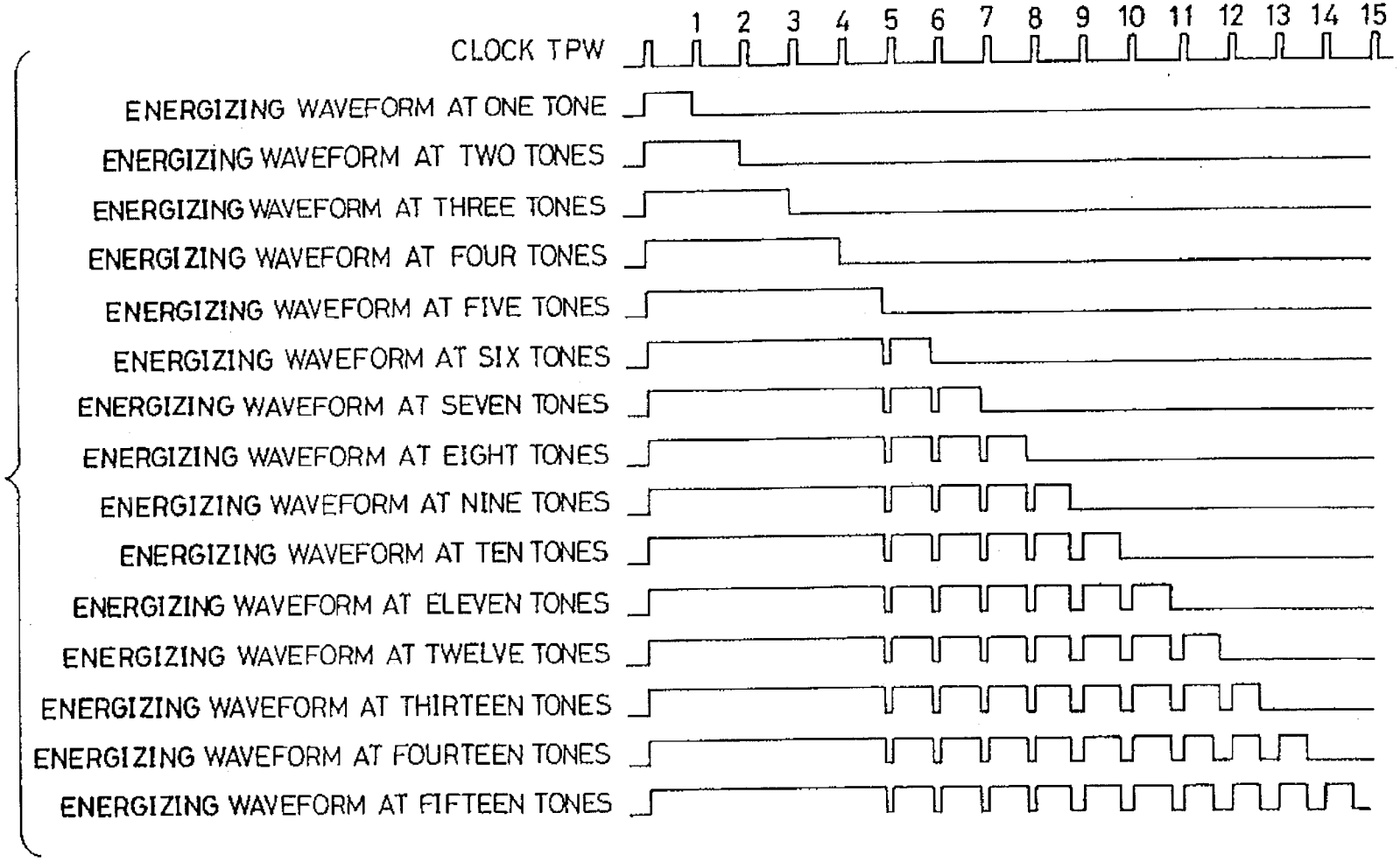
FIG. 3 is a timing chart for explaining an operation of the driving circuit shown in FIG. 1.

If the energizing time is made longer for enhancing the printing density, the energizing waveform is made as shown in FIG. 3. As the energizing time is made longer, the time when the energizing is interrupted is made longer. If the voltage applied on to the head is made higher, the temperature is geared to a predetermined temperature as shown in the thermal head temperature (1) of FIG. 18 even if the energizing time is made longer. The relation between the energizing time and the printing density (2) is made substantially linear on the overall area. If the energizing interrupting time is made too much longer, the temperature of the head is made lower than required. Hence, the energizing interrupting time has to be set to a proper value.

The description will be directed to the thermal type recording apparatus according to an embodiment of the second invention. The head driving circuit of the thermal type recording apparatus of this embodiment is arranged to add the circuit shown in FIG. 4 to the foregoing circuit shown in FIG. 9. A RAM 42 is a page memory for storing the data D1 to D4 to be fed to the latch circuits L1 to Ln shown in FIG. 9. A RAM 42 has a bus configured of a 17-bit address and a 4-bit data. The lower eight bits of the address correspond to the heads and the upper nine bits correspond to the lines in the sub scanning direction for printing, respectively.

A counter 43 is an eight-bit counter, the outputs QA to QH of which are respectively connected to the address inputs A0 to A7 of the RAM 42. The counter 44 is a 9-bit counter, the outputs QA to QI of which are respectively connected to the address inputs A8 to A16 of the RAM 42.

A control circuit 41 operates to output to the control input R/W of the RAM 42 a signal for controlling reading/writing of the RAM 42 and output the L-active load pulse LOAD, a latch pulse TD, a clock TPW, and an inverted page start signal PS. The L-active load pulse LOAD is fed to a clear input CLR of the counter 43, the input of the inverting circuit 45 and the circuit shown in FIG. 9. The latch pulse TD is fed to a clock input CLK of the counter 43 and the circuit shown in FIG. 9. The, clock TPW is fed to the circuit shown in FIG. 9. The L-active page start signal PS is fed to a reset input R of the FF circuit 46 and a clear input of the counter 44.

A ROM 47 has a bus configured of a 5-bit address and a 4-bit data. The bus is provided for reading the data in the ROM 47 corresponding to the addresses of the data D1 to D4 read from the RAM 42. The address inputs A0 to A3 are respectively connected to the data outputs 01 to 04 of the RAM 42. The data outputs 01 to 04 of the ROM 47 are respectively connected to data inputs 1D to 4D of the latch circuit L1 shown in FIG. 9. The address input A4 is connected to the output Q of the FF circuit 46. The ROM 47 stores a program. In the program, the output data D1 to D4 corresponding to the address data ab0 to ab4 of the address inputs A0 to A4 are arranged as listed in Table 2.

TABLE 2

| ab0 | ab1 | ab2 | ab3 | ab4 | D1 | D2 | D3 | D4 |
|---|---|---|---|---|---|---|---|---|
| X | X | X | X | 1 | ab0 | ab1 | ab2 | ab3 |
| 1 | 1 | 1 | 1 | 0 | 1 | 1 | 1 | 1 |
| Except the above | | | | 0 | 0 | 0 | 1 | 1 |

A trigger input T of the FF circuit 46 is connected to the output of the inverting circuit 45. The inverted output Q is connected to the data input D. The output Q is connected to a clock input CLK of the counter 44 and an address input A4 of the ROM 47.

The AND circuits GT1 to GTn shown in FIG. 9 receive a feed of a H-level (+5 V) strobe signal from the driving circuit.

Figure 5:
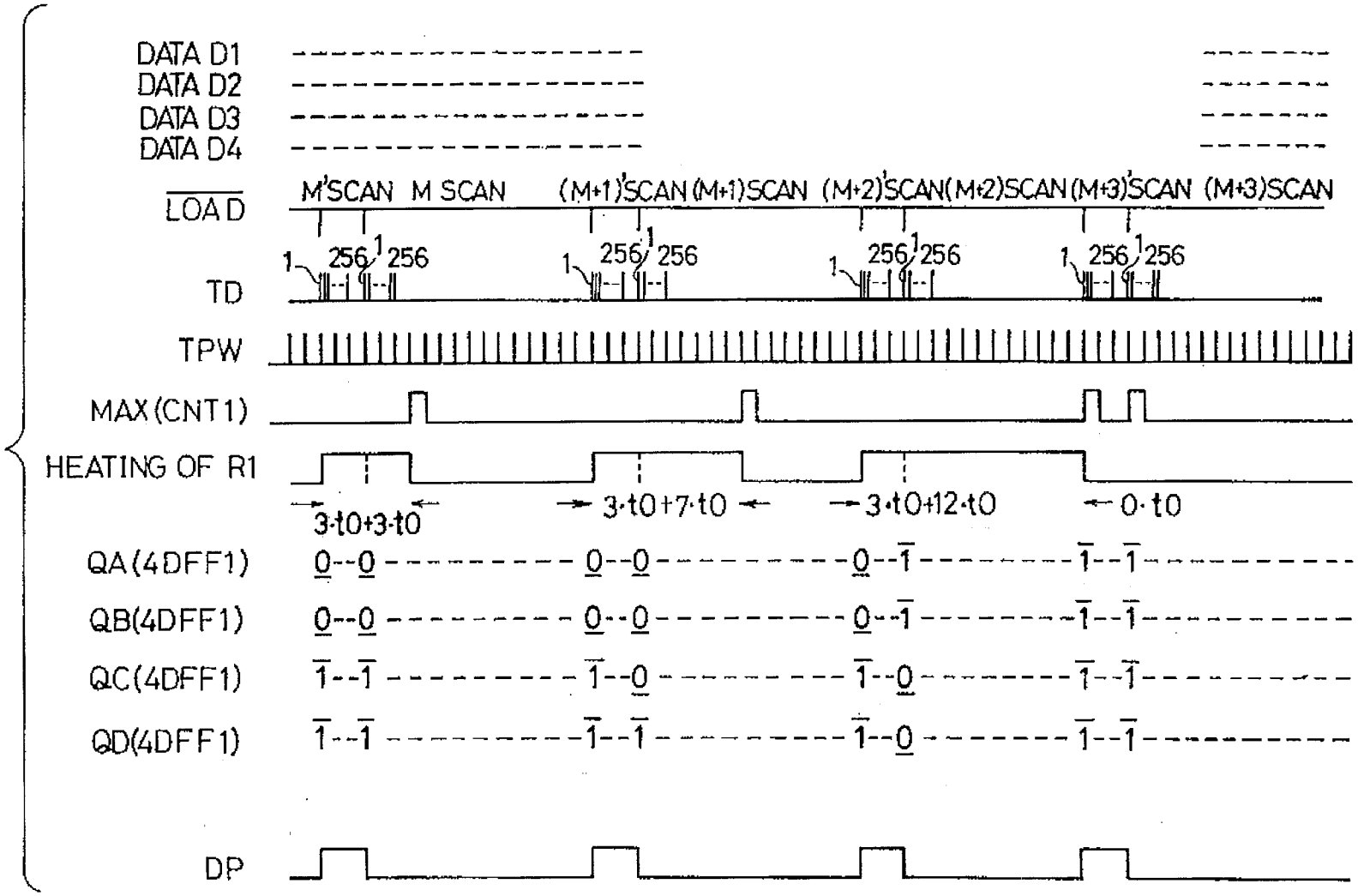
FIG. 5 is a timing chart for explaining an operation of the driving circuit shown in FIG. 4.

The operation will be described as referring to a timing chart of FIG. 5. The control circuit 41 operates to output the inverting page start signal PS for resetting the FF circuit 46 and the counter 44. By resetting the counter 44, the upper 9-bit address data of the RAM 42 is made to be zero. The data output from the RAM 42 is the data stored at the addresses at which the upper 9-bit values of the address data are zero. Then, the counter 44 is counted up, so that the output value is increased one by one. At a time, the upper 9-bit of the address data is increased one by one. Then, the data stored at each address is output.

Figure 4:
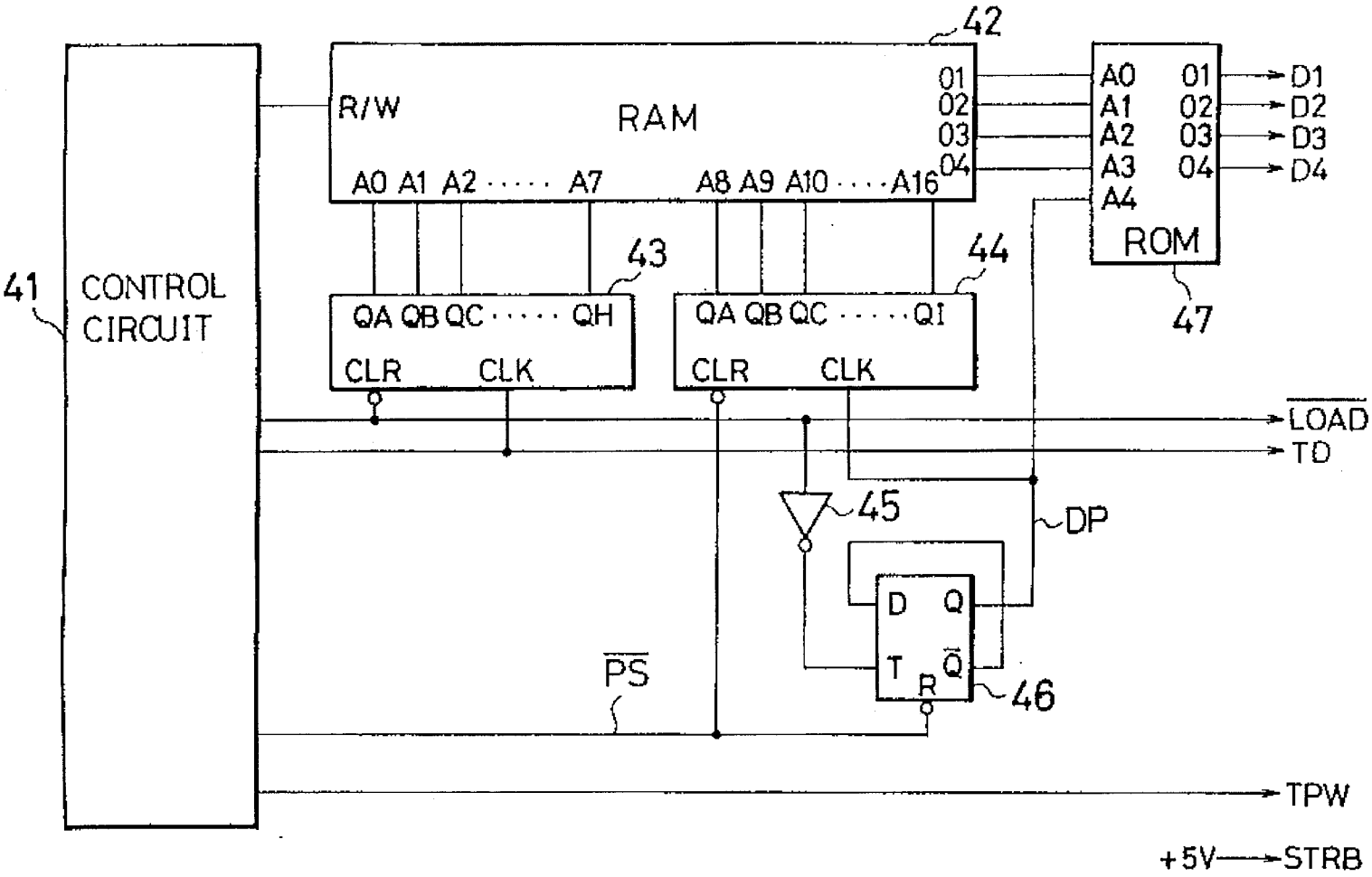
FIG. 4 is a circuit diagram showing a part of a thermal head driving circuit provided in the thermal type recording apparatus according to the second invention.

The control circuit 41 shown in FIG. 4 operates to output an L-active load pulse LOAD at each scan. For example, for an M scan, as shown in FIG. 5, before the L-active load pulse LOAD for starting the actual M scan, for the M' scan which is a dummy scan, an L-active load pulse LOAD is output on the timing before three periods of the clock TPW. The dummy scan means a spared scan in the range of printing the first tone density if one more scan (scan for t0 time) is overlapped, or a bias scan. Likewise, for the (M+1) scan, a load pulse is output for the (M+1)' scan. At each scan, before the load pulse for the actual scan, a load pulse is output for the dummy scan. Each time each load pulse is output, the control circuit 41 outputs 256 latch pulses TD and clocks TPW.

If the load pulse for the M' scan is output, the counter 43 is reset. Each time the latch pulse TD is input, the counter 43 is counted up. Hence, 256 pieces of data are sequentially output from the RAM 42 and fed to the ROM 47. The FF circuit 46 is reset by the initial inverting signal PS of the control circuit 41 so that the L-active load pulse LOAD is input through the inverting circuit 45. The signal DP of the output Q is made at H level. Hence, since the address input A4 of the ROM 47 receives a dummy print signal DP at the H level, assuming that the each data values from the outputs O1 to O4 are 0, 0, 1, 1, all the values are not 1. Hence, the ROM 47 outputs the data D1 to D4 having the values 0, 0, 1, 1.

The data D1 to D4 are held in the latch circuit L1 in the circuit shown in FIG. 9 and then fed to the counter CNT1. Hence, during an interval of 3·t0 as shown in FIG. 5, the transistor TR1 is switched on so that the resistor R1 may be energized.

The control circuit 41 operates to output a load pulse for the M scan. The FF circuit 46 is inverted so that the dummy print signal DP is made at L level. The counter 43 is reset and is started to count up from 0 again. In this case, since the dummy print signal DP is at L level, the ROM 47 outputs the same data D1 to D4 as the data output from the RAM 42. The latch circuit L1 holds the data D1 to D4 having the values of 0, 0, 1 and 1. After an interval of 3·t0, the output MAX of the counter CNT1 is made at H level so that the resistor may be energized for an interval of 3·t0.

When the control circuit 41 outputs a load pulse for the (M+1)' scan, the FF circuit 46 is inverted again so as to output the H-level dummy print signal DP. At this time, if the RAM 42 outputs the data having values of 0, 0, 0 and 1, all the values are not 1. Hence, the ROM 47 outputs the data D1 to D4 having the values of 0, 0, 1 and 1. The output data D1 to D4 are held in the latch circuit L1 and is fed to the counter CNT1. As shown in FIG. 5, like the M' scan, for an interval of 3·t0, the transistor TR1 is switched on so that the resistor R1 is made energized.

The control circuit 41 operates to output a load pulse for the (M+1) scan and the FF circuit 46 is inverted so that the dummy print signal DP is made at L level. The counter 43 is reset and starts to count up again from zero. In this case, since the dummy print signal DP is at L level, the ROM 47 outputs the same data D1 to D4 as the data output from the RAM 42. As stated above, the latch circuit L1 holds the data D1 to D4 having the values of 0, 0, 0 and 1 and the resistor R1 is made energized for an interval of 7·t0.

For the (M+2)' scan, before energizing for an interval of 12·t0 in the actual (M+2) scan, the resistor R1 is made energized for an interval of 3·t0.

For the (M+3)' scan, if the data from the outputs O1 to O4 of the RAM 42 have values of 1, 1, 1, and 1, the ROM 47 operates to output the data D1 to D4 having the values of all "1s" In this case, the resistor 1 is not energized. If the resistor R1 is not energized for the actual scan, it is not energized for the dummy scan.

Figure 19:
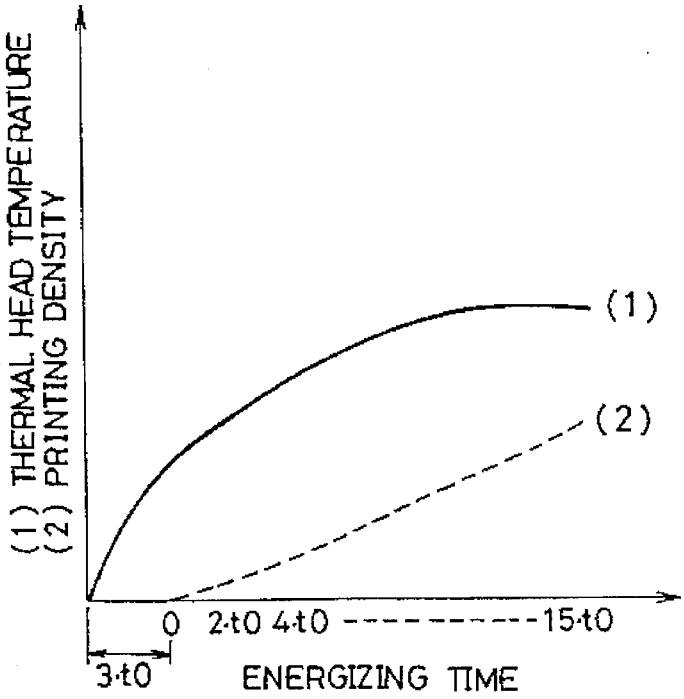
FIG. 19 is a graph showing a relation among a thermal head temperature, a printing density and the corresponding energizing time in the driving circuit according to the invention 2.

In the thermal type recording apparatus according to this embodiment, the relations between the thermal head temperature (1) and the energizing time and between the printing density (2) and the energizing time are illustrated in FIG. 19. In the low printing density area, the excellent linearity can be obtained.

Figure 6:
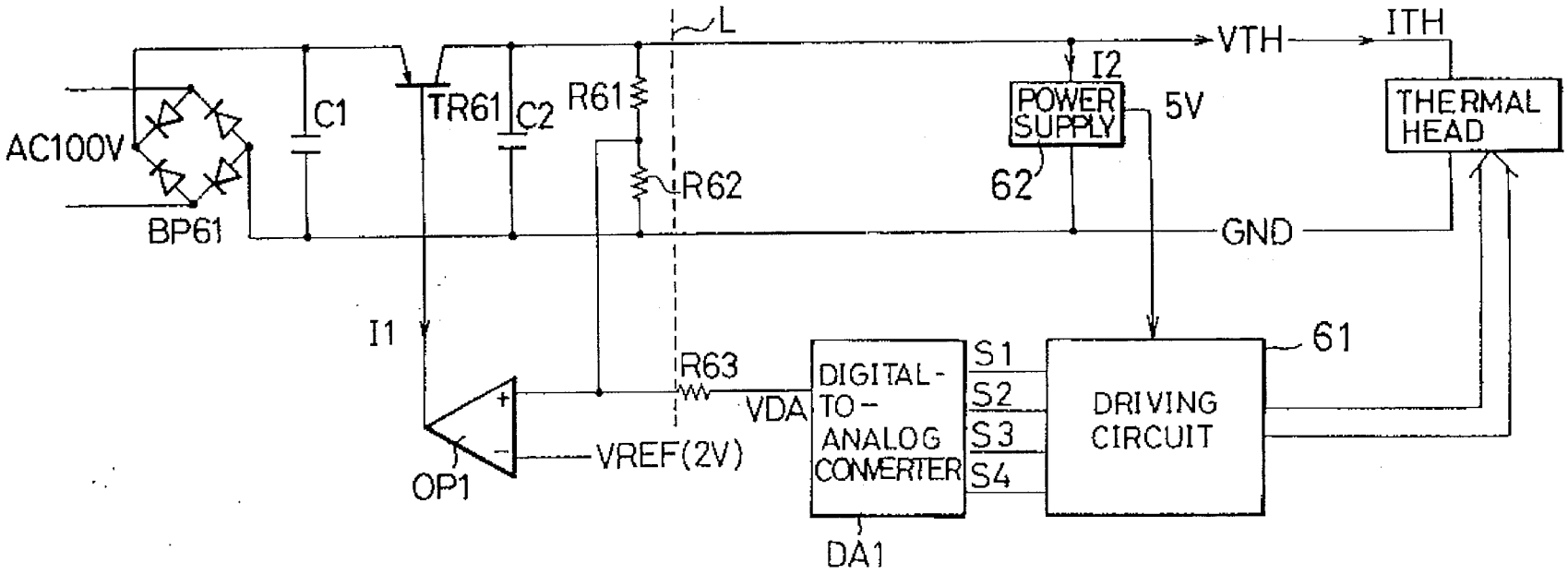
FIG. 6 is a circuit diagram showing a power supply included in the thermal type recording apparatus according to the third invention.

The description will be oriented to the thermal type recording apparatus according to an embodiment of the third invention as referring to the drawings. The power supply of the thermal head provided in the thermal type recording apparatus according to this embodiment has an arrangement shown in FIG. 6. The circuit in the left hand of a dotted line L of FIG. 6 is arranged on the prior art. The circuit in the right hand of the dotted line L is an additional one for implementing this invention.

A full-wave rectifier BR61 operates to rectify a voltage of AC100V and a capacitor C1 connected between the output terminals operates to smooth the rectified voltage. A transistor TR61 operates to stabilize the voltage and has an emitter connected to one end of the capacitor C1. The base of the transistor TR61 is connected to an output of an operational amplifier OP1. Between the collector of the transistor TR61 and the other end of the capacitor C1, that is, the ground side, a capacitor C2 and resistors R61 and R62 are connected in series. The collector of the transistor TR61 is an output of this power supply. The voltage VTH is fed to each element of the thermal head, that is, the resistors R61 to Rn shown in FIG. 9. The contact between the resistors R61 and R62 is connected to an non-inverted input of the operational amplifier. At the inverted input of the operational amplifier OP1, there is applied a reference voltage VREF of 2 V.

Figure 7:
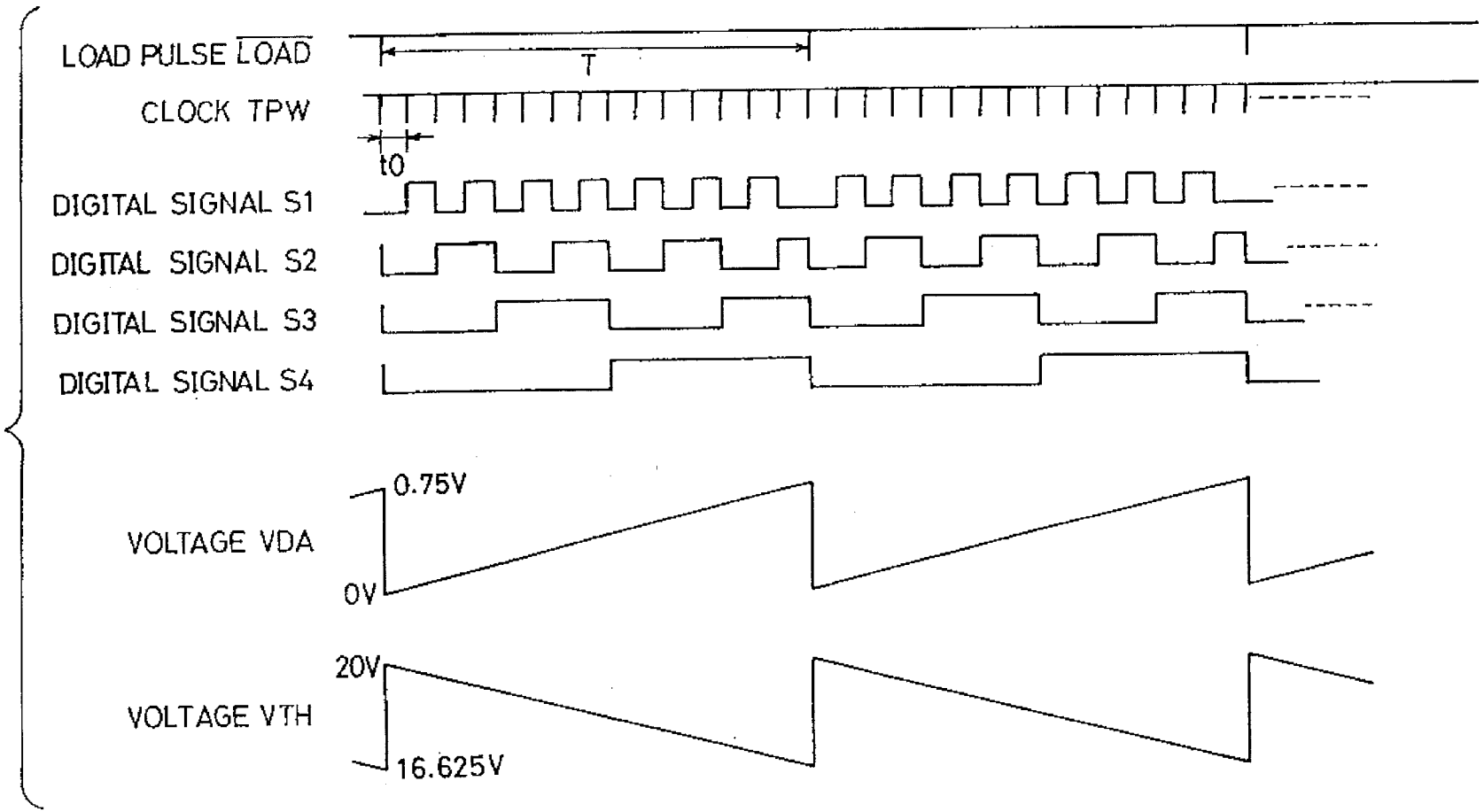
FIG. 7 is a timing chart for explaining an operation of the circuit shown in FIG. 6.

The driving circuit 61 is arranged of the circuit shown in FIG. 9 and the circuit for generating digital signals S1, S2, S3 and S4. The forms of the digital signals S1 to S4 are shown in FIG. 7. The signal S1 has a double period of the clock TPW fed to the circuit shown in FIG. 9. On the timing of the L-active load pulse LOAD, the signal S1 is at L level. The signals S2 to S4 are signals formed by dividing the signal S1 into a half in a cascade manner at the first stage of the signal S1. To the driving circuit 61, a voltage of 5 V is fed as a power from the collector of the transistor TR61, that is, the power supply 62 connected between the output terminal of the power supply 62 itself and the ground. As the power supply 62, it is better to use the switching power supply for more efficiency.

DA1 is a four-bit D/A converter having the signals S1 to S4 as inputs. The output voltage VDA is fed to a non-inverted input of the operational amplifier OP1 through the resistor R63. It is designed so that the output voltage VDA may be 0.05×(1·s1+2·s2+4·s3+8·s4). The symbols s1 to s4 stand for the logical values of the signals S1 to S4, respectively.

The operation will be described. If the voltage at the non-inverted input of the operational amplifier OP1 is higher than the voltage at the inverted input thereof, the output current I1 is made smaller. This results in lowering the current fed from the transistor TR61 to the capacitor C2 and the load. With reduction of the current, the voltage VTH is made lower. If the resistor R63 is not connected and the resistor R61 has a value of 9 KΩ and the resistor R62 has a value of 1 KΩ, the voltage VTH can be obtained by the following expression.

$$VTH=\{(R61+R62)/R62\}\cdot VREF=20\text{ V}$$

In this power supply, the voltage VDA is fed to the operational amplifier OP1 through the resistor R63. Hence, the voltage VTH is represented by the following expression.

[0059]
VTH = {(R61 · R62 + R62 · R63 + R63 · R61)/R62 · R63} · VREF − (R61/R63) · VDA

In this expression, if the resistor R61=9 KΩ and R62=R63=2 KΩ, the voltage VT is made to be 20 V–4.5 VDA.

The signals S1 to S4 are as shown in FIG. 7. The voltage VDA is made zero if a load pulse is input and rises linearly with the time. The maximum voltage is 0.75 V. That is, the waveform of the voltage VDA is a triangular wave with a minimum of 0 V and a maximum of 0.75 V at a period T of the L-active load pulse LOAD. The voltage VTH applied to the head is a triangular wave with 20 V for the voltage VDA of 0 V and 16.625 V for the voltage VDA of 0.75 V.

Figure 18:
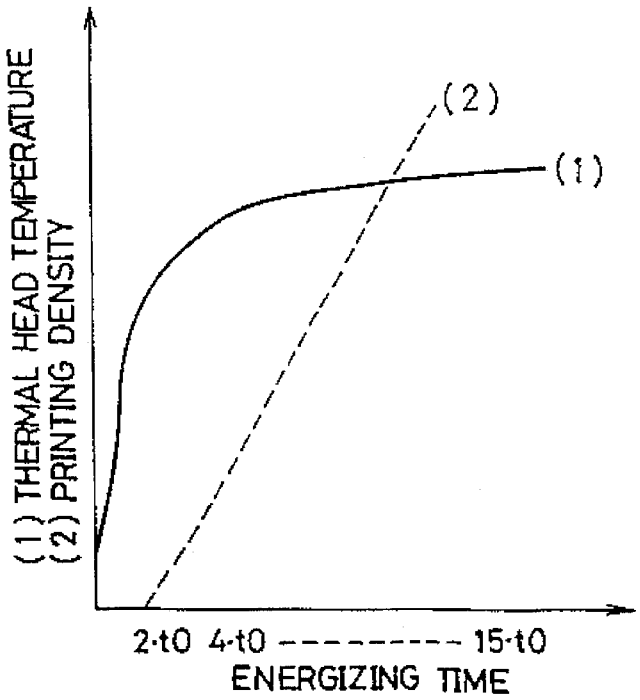
FIG. 18 is a graph showing a relation among a thermal head temperature, a printing density, and the corresponding energizing time in the driving circuit according to the invention 1.

The voltage applied to the head is made lower as the printing density is made higher. For example, for the first tone printing, the voltage VTH is about 20 V and for the 15-tone printing, the voltage VTH is roughly 16.625 V. If the voltage applied to the head is generally made higher, as shown in FIG. 18, the longer energizing time does not enhance the thermal head temperature (1) higher than a constant temperature and keep the relation between the energizing time and the printing density (2) substantially linear on the overall area.

If the voltage is set higher, the power supply, in general, responds to the control faster. If it is set lower, it responds to the control slower. For the circuit shown in FIG. 6, assuming that the currents 12 and ITH are both made zero and R61>>R62, R63, the voltage VTH is made lower with a time constant of τ=C2·R61. C2=1000 μF is set. Since R61=91 KΩ, τ=9 sec is given. The period T of one-line printing of the normal sublimation type printer is 10 msec. Hence, the aforementioned time constant is made larger by two digits than that of the normal sublimation type printer.

To enhance the lowering speed of the voltage, it is necessary to increase the load current. In this embodiment, the head as well as the power supply 62 of the driving circuit 61 are connected so as to assume the driving circuit 61 as load. Assuming that the current ITH=0, it is necessary to lower the voltage VTH by 4.5 V and DA by 3.375 V for an interval of 10 msec. The relation of cv=it is established among the capacitance c of the capacitor, the applied voltage v of the capacitor, the flowing current i, and the voltage-applying time t. Hence, the following expression is established.

$$C2\times 3,375=I2\times 10\times 10^{-3}$$

By the above expression, the current I2 flowing through the power supply 62 has to be 0.3375 A or more. If the addition of the driving circuit 61 as load does not meet with the above condition, it is necessary to add another load. The additional load is, for example, a pulse motor (not shown) for driving the printer or a cooling fan.

Figure 11:
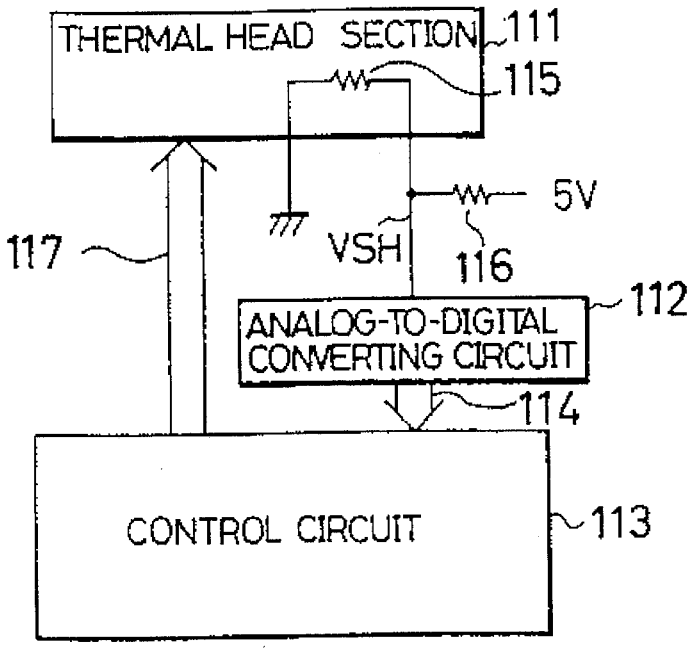
FIG. 11 is a block diagram showing a main functional part of the thermal type recording apparatus according to the fourth invention.

The description will be directed to the thermal type recording apparatus according to an embodiment of the fourth invention. FIG. 11 shows one embodiment of this invention, which is arranged to have a thermal head and its driving circuit. FIG. 11 is a functional block diagram showing a thermal head section 111, an analog-to-digital converting circuit 112, a control circuit 113 and a resistor 116. The thermal head section 111 and the control circuit 113 are connected through a thermal head driving line 117. The analog-to-digital converting circuit 112 and the control circuit 113 are connected through a signal line 114. The thermal head section 111 includes a thermistor 115.

Figure 8:
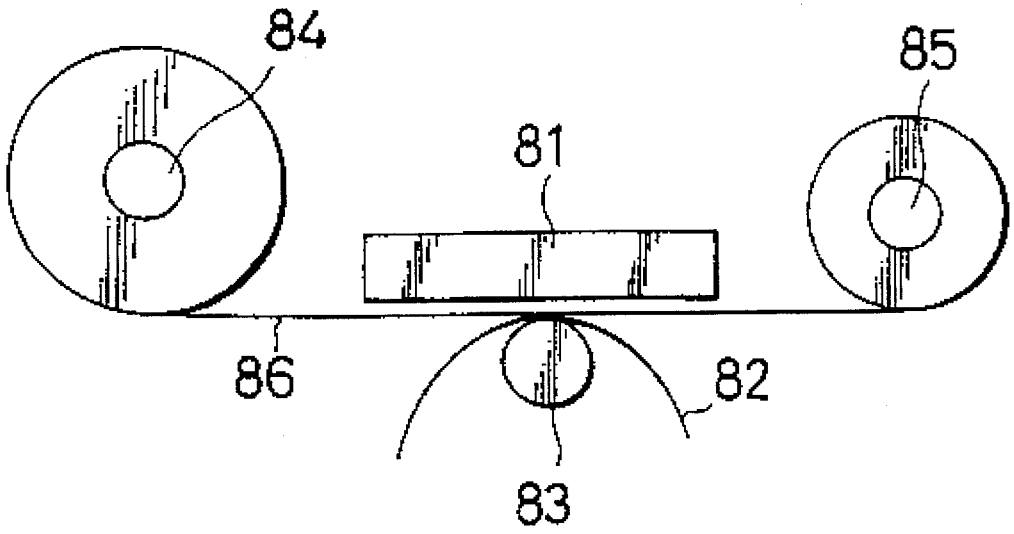
FIG. 8 is a block diagram showing a thermal head section included in the thermal type recording apparatus.

This circuit is analogous in basic function to the driving circuit for the thermal head as shown in FIG. 8. This circuit provides the thermistor 115, the resistor 118 and the analog-to-digital converting circuit 113 as additional components. The thermal head section 111 corresponds to the section 81 shown in FIG. 8. The thermistor 115 for sensing an ambient temperature is additionally mounted nearby the thermal head.

One end of the thermistor 115 is connected to the ground of the circuit. The other end is connected to a 5 V power supply through the resistor 116. A voltage dividing signal VSH caused by the thermistor 115 and the resistor 116 is led to the analog-to-digital converter 112, the output of which is connected to the control circuit 113.

The thermistor 115 is provided for sensing an ambient temperature. The resistance of the thermistor 115 changes low at a high temperature and high at a low temperature. The change of the resistance of the thermistor 111 is sensed by the change of the voltage of the voltage dividing signal VSH. The analog-to-digital converting circuit 112 serves to convert this signal into a digital value and output it to the control circuit 113. The control circuit 113 enables to know the actual ambient temperature, based on the voltage dividing signal VSH given by the analog-to-digital converting circuit 112. According to the change of the ambient temperature, the energizing time of the head is changed. The energizing time is controlled by the control circuit based on the data 114 sent from the analog-to-digital converter shown in FIG. 9.

One embodiment of the energizing time for the head is listed in Table 3. This table lists a relation among a printing tone, an ambient temperature and an energizing time for the head. The ambient temperature is roughly 25° C. and 50° C.

TABLE 3

| | energizing Time for Thermal Head (Unit:to) | |
|---|---|---|
| Expression 1 | When the ambient temperature is 25° C. | When the ambient temperature is 50° C. |
| 0 | 0 | 0 |
| 1 | 4 | 3 |
| 2 | 5 | 4 |
| 3 | 6 | 5 |
| 4 | 7 | 6 |
| . | . | . |
| . | . | . |
| . | . | . |
| 14 | 17 | 16 |
| 15 | 18 | 17 |

Figure 12:
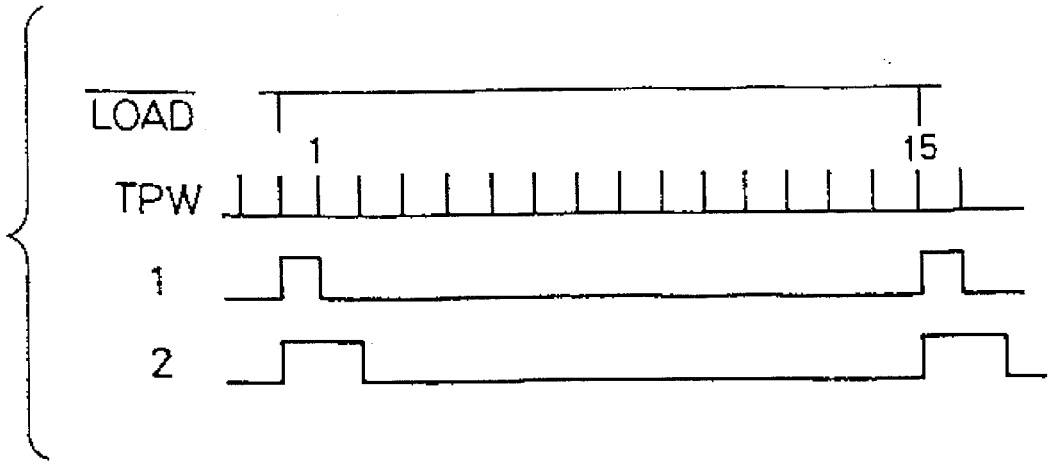
FIG. 12 is a first timing chart for explaining an operation of the circuit shown in FIG. 11.
Figure 13:
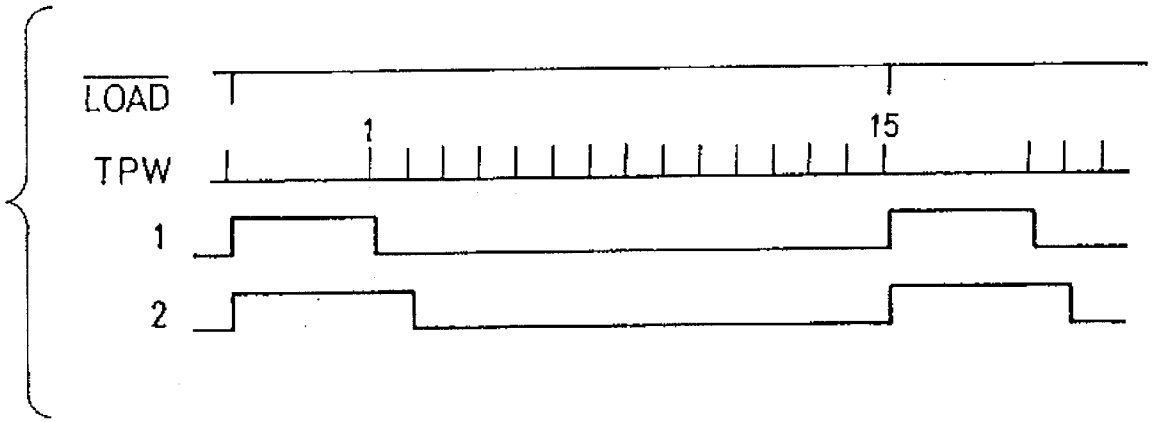
FIG. 13 is a second timing chart for explaining an operation of the circuit shown in FIG. 11.
Figure 14:
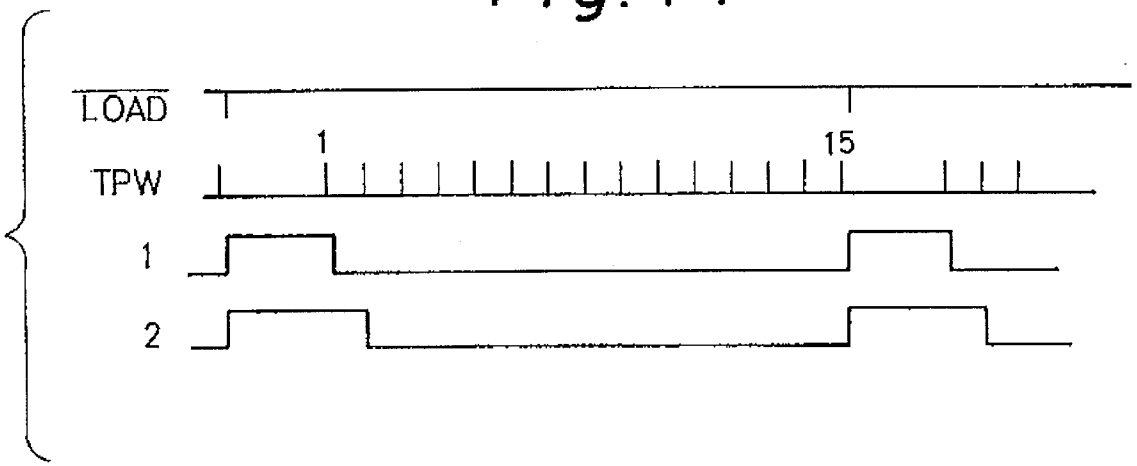
FIG. 14 is a third timing chart for explaining an operation of the circuit shown in FIG. 11.
Figure 15:
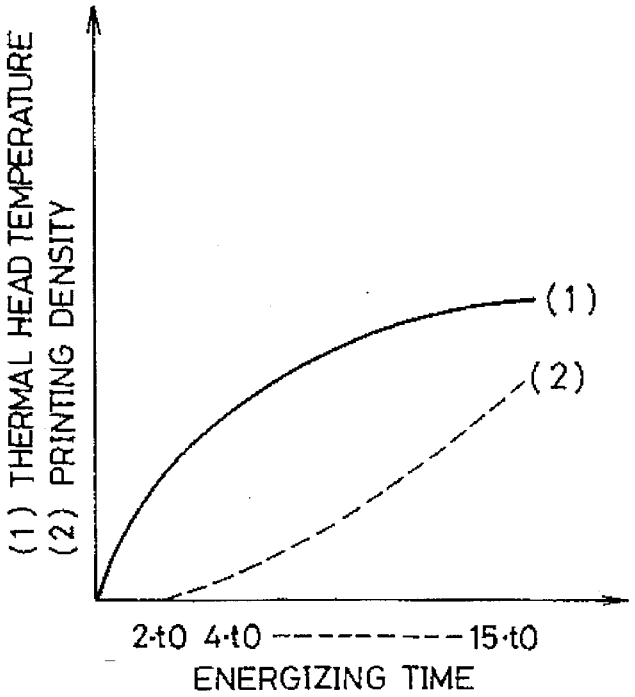
PRIOR ART Fig. 15
FIG. 15 is a first graph showing a relation among a thermal head temperature, a printing density and the corresponding energizing time in the driving circuit according to the prior art.
Figure 16:
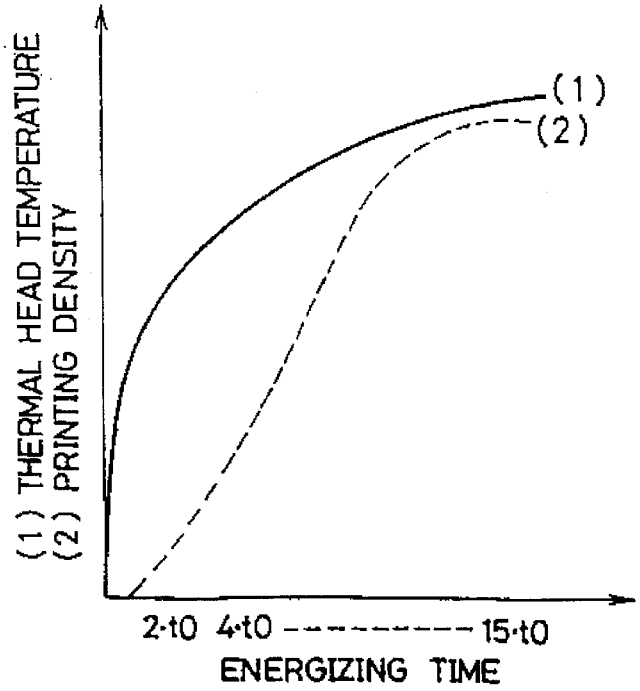
Fig. 16 PRIOR ART
FIG. 16 is a second graph showing a relation among a thermal head temperature, a printing density and the corresponding energizing time in the driving circuit according to the prior art.
Figure 17:
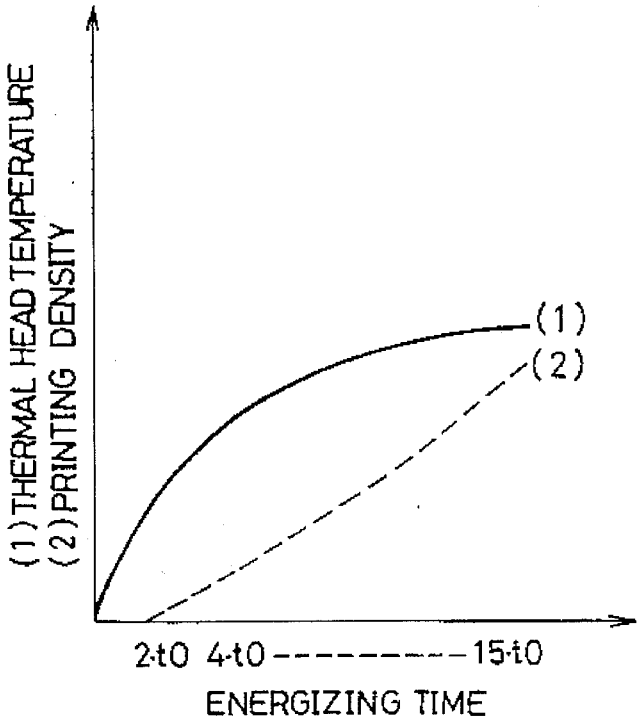
Fig. 17 PRIOR ART
FIG. 17 is a graph showing a relation among a thermal head temperature, a printing density and the corresponding energizing time in the ambient temperature of 50° C. in the driving circuit according to the prior art.
Figure 20:
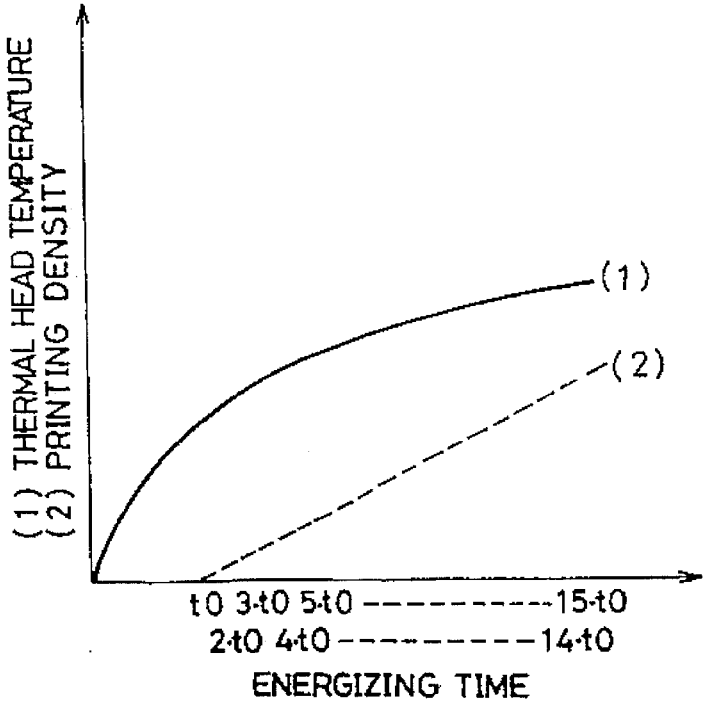
FIG. 20 is a graph showing a relation among a thermal head temperature, a printing density, and the corresponding energizing time in the ambient temperature of 25° C. in the driving circuit according to the invention 4.
Figure 21:
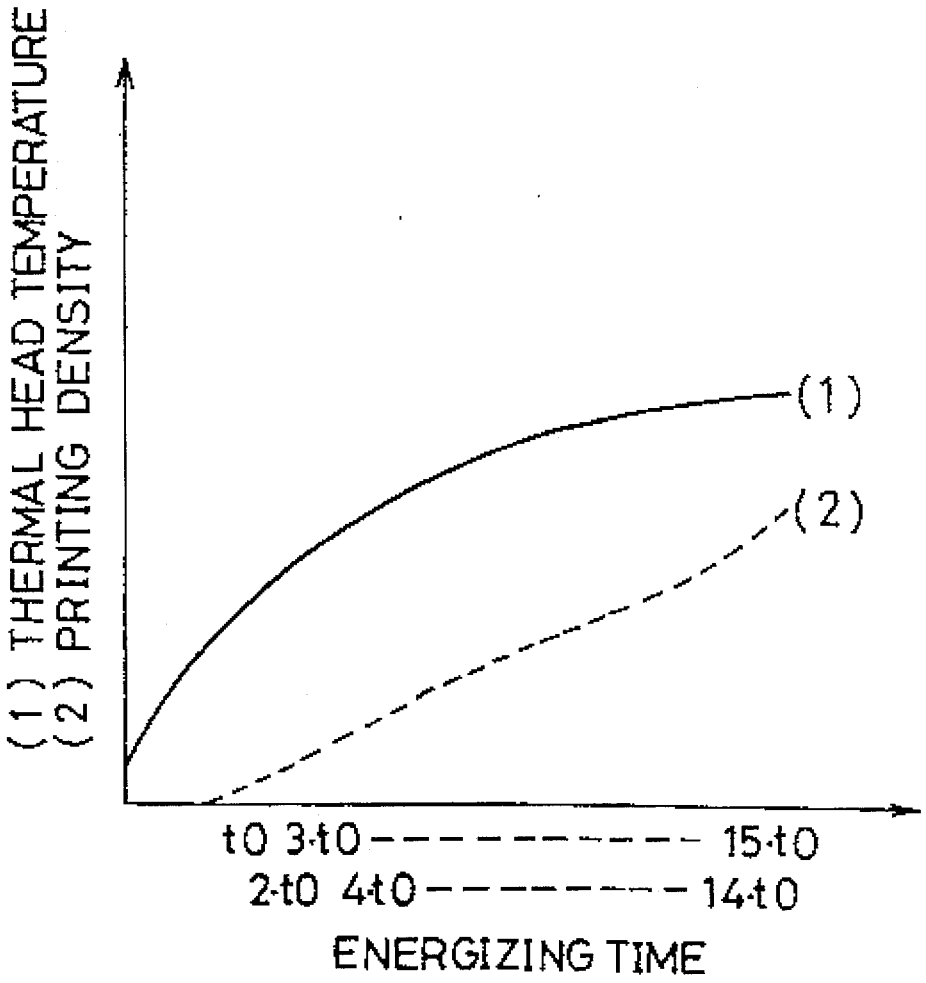
FIG. 21 is a graph showing a relation among a thermal head temperature, a printing density and the corresponding energizing time in the ambient temperature of 50° C. in the driving circuit according to the invention 4.

The expression 1 in this table is expression $1=2^0 \cdot D_1+2^1 \cdot D^2+2^2 \cdot D_3+2^3 \cdot D_4$, in which D1 to D4 stand for printing tone data. The numerical values of the energizing time for the head stand for a multiple of a unit reference time t0. This relation is shown in FIGS. 12 to 14. FIG. 12 represents the energizing time of the printing tone "1" and "2" based on the prior art. The relation between the thermal head temperature (1) and the printing density (2) in the case of the ambient temperature of 25° C. is shown in FIG. 15. The relation in the case of the ambient temperature of 50° C. is shown in FIG. 17. The relation in the case of the ambient temperature of 25° C. is shown in FIG. 20. The relation in the case of the ambient temperature of 50° C. is shown in FIG. 21.

As described above, in the halftone recording method employed in the thermal type recording apparatus according to the first invention, when the energizing time for a thermal head is equal to or more than a predetermined value, the energizing is interrupted for a predetermined time once or more times. Hence, if the voltage applied onto the head is made higher, in case of a longer energizing time, it is possible to prevent the temperature of the head from being raised to a predetermined temperature. It is possible to implement the thermal type recording apparatus which can solve the problem that no printing is carried out in the case of a low tone density and the printing density is saturated in the case of a high tone density and operates to change the printing density linearly to the energizing time. In addition, by preventing the heating of the head temperature, it is possible to extend the life of the head.

The thermal type recording apparatus according to the second invention serves to preliminarily energize the head for a predetermined time before energizing the head for printing. For the low tone density, printing at the density for each tone is carried out. The printing density changes linearly on the overall area along the energizing time.

The thermal type recording apparatus according to the third invention operates to apply a higher voltage onto the head when the recording density is low and a lower voltage onto the head when it is high. Hence, it is possible to implement the thermal type recording apparatus which can solve the problem that no printing is carried out in the case of a low tone density and operates to change the printing density linearly to the energizing time.

According to the fourth invention, it is possible to sense the ambient temperature with the temperature sensing element and keep the printing density to a predetermined value and guarantee the tone change by changing the energizing time to the head on the sensed temperature.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal type recording apparatus for performing printing at multi-tone density by changing an energizing time of a thermal head, comprising:

means for performing energizing of said thermal head;

means for outputting, at the beginning of a dummy printing period prior to a printing period associated with a tone density to be printed, a first data when said tone density is not zero and a second data when said tone density is zero, and for outputting at the beginning of said printing period, data for defining the length of said printing period; and control means for actuating said energizing means in such a manner that said thermal head is energized for said dummy printing period and said printing period when said first data is outputted, and that said thermal head is not energized through said dummy printing period and said printing period when said second data is outputted.

2. The thermal type recording apparatus as claimed in claim 1, wherein said means for outputting includes a third counter, a fourth counter, a RAM connected to receive an output of said third counter and an output of said fourth counter, a flip-flop for generating a signal representative of said dummy print period, and a ROM connected to receive an output of said RAM and said signal representative of said dummy print period.

* * * * *